United States Patent [19]

Beimesch et al.

[11] Patent Number: 4,477,383

[45] Date of Patent: Oct. 16, 1984

[54] DI- AND TRIPENTAERYTHRITOL ESTERS OF ISOSTEARIC ACID

[75] Inventors: Bruce J. Beimesch, Crescent Springs, Ky.; Nicholas E. Schnur, Cincinnati; Clarence J. Hughes, Jr., Camp Dennison, both of Ohio

[73] Assignee: National Distillers and Chemical Corporation, New York, N.Y.

[21] Appl. No.: 375,058

[22] Filed: May 5, 1982

[51] Int. Cl.[3] ..... C09F 5/08

[52] U.S. Cl. ..... 260/410.6; 252/565

[58] Field of Search ..... 260/410.6

[56] References Cited

U.S. PATENT DOCUMENTS

| | | | |
|---|---|---|---|
| 3,069,475 | 12/1962 | Sidi et al. | 260/410.6 X |
| 3,074,981 | 1/1963 | Aylesworth et al. | 260/410.6 |
| 3,485,754 | 12/1969 | Boylan et al. | 260/410.6 |
| 4,025,447 | 5/1977 | Mancini et al. | 260/410.6 X |
| 4,032,303 | 6/1977 | Dorer et al. | 44/70 |
| 4,032,304 | 6/1977 | Dorer et al. | 44/70 |
| 4,053,491 | 10/1977 | Koch | 260/410.6 |
| 4,065,418 | 12/1977 | Foulks et al. | 260/410.9 R |
| 4,212,816 | 7/1980 | Hentschel et al. | 260/410.6 |
| 4,234,497 | 11/1980 | Honig | 260/410.6 |
| 4,243,540 | 1/1981 | Mancini et al. | 260/410.6 X |
| 4,363,763 | 12/1982 | Peterson | 260/410.6 X |

*Primary Examiner*—Helen M. S. Sneed

*Attorney, Agent, or Firm*—Kenneth D. Tremain; Gerald A. Baracka

[57] ABSTRACT

Dipentaerythritol and tripentaerythritol esters of isostearic acid are disclosed. The polyol ether esters of this invention exhibit low volatility and good oxidative and thermal stability and are useful lubricants for high temperature applications.

5 Claims, No Drawings

DI- AND TRIPENTAERYTHRITOL ESTERS OF ISOSTEARIC ACID

BACKGROUND OF THE INVENTION

1. Field of the Invention:

This invention relates to di- and tripentaerythritol esters of isostearic acid characterized by having low volatility and excellent thermal and oxidative stability and which are useful high temperature lubricants. The products of this invention are especially useful as chain and bearing lubricants in applications where a wide range of temperatures are encountered.

2. Description of the Prior Art:

Esters based on polyols and aliphatic monocarboxylic acids are known and are widely used as automotive, industrial and turbine lubricants. These products are primarily derived from neopentyl glycol, trimethylolpropane, pentaerythritol, dipentaerythritol, tripentaerythritol, or mixtures thereof, and saturated monocarboxylic acids having from about 5 to 10 carbon atoms. Many of these esters are derived from mixed acids of different chain length or branched and unbranched acids having the same or different chain lengths.

Polyol esters derived from higher fatty acids have recently been disclosed in U.S. Pat. No. 4,243,540 as a component for multi-grade lubricating oils useful in internal combustion engines. These esters are obtained by the reaction of a mixture of bifunctional and trifunctional polyols with a mixture of $C_{6-8}$ linear monocarboxylic acids and $C_{12-18}$ linear monocarboxylic acids. Also, in U.S. Pat. No. 4,053,491 branched-chain aliphatic ester products derived from branched-chain aliphatic polyols having from 2 to 6 hydroxyl groups and alpha-branched chain alkanoic acids having from 14 to 22 carbon atoms are disclosed as being useful for lubricants and hydraulic fluids. Polyol esters derived from mixed acids wherein iso-palmitic acid is a minor component are the subject of U.S. Pat. No. 4,234,497. The major acid component for these polyol esters is a $C_{5-11}$ monocarboxylic acid or mixture and the polyol ester products are used as synthetic lubricant base stocks in automotive applications. Monocarboxylic acids containing up to 18 carbon atoms are disclosed in U.S. Pat. No. 2,975,152 for the preparation of esters of pentaerythritol or polypentaerythritols useful as plasticizers for vinyl halide polymers.

In U.S. Pat. No. 3,526,596 esters useful as lubricants for shaping and working metals at high temperatures are disclosed. The esters are derived from polyols having 2 to 12 hydroxyl groups and $C_{12-22}$ fatty acids. Branched-chain acids obtained from oxidation of oxo process compounds or oxidation of alpha-olefins or alpha-olefin derived alcohols are indicated to be useful acids for the preparation of these polyol ester metal-working lubricants.

Isostearic acid esters of neopentyl glycol, trimethylol propane and pentaerythritol are disclosed by Boehringer et al. in U.S. Pat. No. 3,585,138 as useful base fluids for the preparation of synthetic greases. Also, in U.S. Pat. No. 3,074,981 isostearic acid esters of polyols containing a total of 5 to 7 carbon atoms and 2 to 4 methylol groups are disclosed as lubricants particularly adapted for use in jet engines.

SUMMARY OF THE INVENTION

This invention relates to useful high temperature ester lubricants derived from isostearic acid and ether polyols. The polyol ether ester products of this invention exhibit low volatility, good oxidative and thermal stability and can be effectively utilized in high temperature applications for lubrication of chains, pulleys, trolleys and bearings without the addition of antioxidants, stabilizers or the like. By the utilization of these products in high temperature lubrication applications residue build up on the lubricated surface is minimized even after extended periods of operation. This results in extended equipment life, reduced maintenance and increased efficiency.

The products of this invention are obtained by reacting an ether polyol of pentaerythritol having from 6 to 8 hydroxyl groups with isostearic acid. Most generally the ether polyols will contain at least 85% dipentaerythritol, tripentaerythritol and higher pentaerythritol oligomers with less than 15% monopentaerythritol and the isostearic acid will contain no more than 35% by weight straight-chain fatty acids. The lubricant ester products typically have hydroxyl values less than 10, flash points greater than 500° F. and 210° F. viscosities in the range 20 to 40 cSt.

DETAILED DESCRIPTION

The lubricant esters of this invention are obtained from ether polyols of pentaerythritol having from 6 to 8 hydroxyl groups and, more specifically, dipentaerythritol, tripentaerythritol and mixtures thereof. Useful ether polyols contain at least 85% di-, tri- and or higher pentaerythritol oligomers with less than 15% monopentaerythritol. Mixtures of dipentaerythritol and tripentaerythritol are preferably employed in view of their commercial availability and for such mixtures the ratio of di- to tri- will range from about 9:1 to 1:9 and the amount of monopentaerythritol will be less than 10%. The amount of pentaerythritol oligomers higher than tripentaerythritol will generally not exceed about 20 percent by weight.

To obtain the lubricant esters, isostearic acid (a saturated fatty acid of the empirical formula $C_{17}H_{35}COOH$) is reacted with the above-defined ether polyol or ether polyol mixture. Isostearic acid is a readily available commercial product obtained as a by-product from the manufacture of polymer fatty acids (dimer and trimer acids) by the polymerization of naturally occuring unsaturated $C_{18}$ fatty acids. During the polymerization a portion of the $C_{18}$ monomer acid rearranges to yield a branched-chain $C_{18}$ monocarboxylic acid product which is then isolated by distillation. Whereas the exact structure of the $C_{18}$ branched-chain product has not been elucidated, the principal components of the acid are methyl-branched isomers.

The isostearic acid can contain up to 35 percent by weight saturated straight-chain $C_{8-18}$ fatty acids. Preferably these straight-chain acids will constitute 25 percent or less of the isostearic acid component. Some straight-chain acids are typically present in the isostearic acid as obtained from the polymerization process, however, additional straight-chain acids may be blended with the isostearic acid so long as the above-identified limits are not exceeded.

The esters are obtained utilizing conventional esterification procedures. This generally involves reacting a molar excess of the isostearic acid with the ether polyol at an elevated temperature while removing water. The reaction may be carried out by refluxing the reactants in an azeotroping solvent, such as toluene or xylene, to facilitate removal of water. Esterification catalysts may be used but are not necessary for the reaction. At the completion of the reaction the excess acid and any solvent can be separated from the ester by vacuum stripping or distillation.

The ester product thus produced may be utilized as such or it may be alkali refined or otherwise treated to reduce the acid number, remove catalyst residue, reduce the ash content, etc. For the purpose of this invention essentially all of the hydroxyl groups are reacted and the resulting ester products have hydroxyl values (mg KOH/g) less than 10. The polyol ether esters also typically have flash points greater than 500° F., pour points of 20° F. or below, 210° F. viscosity in the range 20 to 40 cSt. and 100° F. viscosity in the range 200 to 350 cSt.

The polyol ether esters exhibit low volatility when exposed to high temperature environments and are resistant to oxidative and thermal degradation. In view of these characteristics, the products are highly effective as high temperature chain and bearing lubricants without additional formulation and have the further advantage that buildup of undesirable residue on the lubricated surface is minimized. While the di- and tripentaerythritol esters may be used as such for most applications and do not require additional additives, where more stringent conditions are encountered the addition of corrosion inhibitors, antiwear agents, antioxidants and the like may be advantageous. The esters are readily compatible with conventional additives and additive packages utilized for such purpose and said additives may be incorporated at the customary levels without problem and without special processing.

The following examples illustrate the preparation of the products of this invention and demonstrate the utility of the resulting lubricant esters.

EXAMPLE I

An ester comprised predominantly of dipentaerythritol hexaisostearate was prepared by reacting commercially available dipentaerythritol (86% dipentaerythritol/6.5% tripentaerythritol) and isostearic acid (Emersol ® 875 Isostearic Acid). For the reaction 397 parts dipentaerythritol and 3202 parts (10% equivalents excess) isostearic acid were charged to a glass reaction vessel equipped with a stirrer, nitrogen inlet, thermometer and condenser equipped with a water trap arrangement. The reaction mixture was then heated at 200° C. with stirring under a nitrogen atmosphere until the theoretical amount of water was recovered (approximately 6 hours). The temperature was then raised to 240° C. and a vacuum applied to the system to remove the final traces of water. When the hydroxyl value was less than 10, unreacted isostearic acid was stripped from the reaction mixture, 1% diatomaceous earth added with agitation, and the final ester product recovered by filtration. The resulting ester product had the following properties:

| | |
|---|---|
| Viscosity (ASTM D-445) | |
| 210° F. | 24.4 cSt. |
| 100° F. | 245.3 cSt. |
| Viscosity Index (ASTM D-2270) | 135 |
| Pour Point, (ASTM D-97) | 5° F. |
| Cloud Point (ASTM D-2500) | 40° F. |
| Flash Point (ASTM D-92) | 555° F. |
| Fire Point (ASTM D-92) | 610° F. |
| Autoignition temperature | 800° F. |

-continued

| | |
|---|---|
| (ASTM D-2155) | |
| Ash | 0.01 wt. % |
| Acid Value (mg KOH/g) | 3.9 |
| Hydroxyl Value (mg KOH/g) | 8.0 |
| Color (Gardner) | 3 |

The above-prepared ester product was a highly effective chain lubricant and exhibited low volatility at operation temperatures in excess of 500° F. Further, as a result of its excellent oxidative and thermal stability, lubrication was accomplished with minimal buildup of undesirable residual material. The superior properties of the ester are evident from the results obtained when the product was subjected to thermal gravimetric analysis. For this test the ester was heated in a nitrogen flow (80 ml per minute) while increasing the temperature at a rate of 10° C. per minute and measuring the weight loss of the sample. With the dipentaerythritol hexaisostearate only 10% weight loss was obtained at 750° F. and the temperature was increased to about 860° F. before 50% sample loss was realized. The advantages of the ester lubricants of this invention are readily apparent when these data are compared with the results obtained with a conventional commercially available pentaerythritol ester promoted as a high-temperature chain lubricant. The commercial product (Emery ®2935 Synthetic Lubricant Base Stock) gave 10% and 50% weight loss at 570° F. and 590° F., respectively.

The dipentearythritol hexaisostearate can be effectively utilized to lubricate chains, trolley wheels and bearings and is particularly effective for such applications where high temperatures are encountered. Maximum advantage is achieved where operating temperatures of 500° F. or higher, and in some cases as high as 600° F., are utilized. Such high temperature conditions are typically encountered in textile curing ovens, plywood drying ovens, lithographing ovens, annealing furnaces and with equipment used for the production of glass and ceramics. In view of the low volatility, excellent oxidative and thermal stability and exceptional viscosity characteristics of the product, it is a highly effective lubricant at these high temperatures and eliminates or significantly reduces most lubricant related problems. Furthermore, it is possible in certain of the aforementioned applications, where lubricant performance is a limiting factor, to increase the operating temperature and thereby increase the output and productivity of the process.

EXAMPLE II

In a manner similar to that described in Example I, an ester of a commercially available pentaerythritol product comprised of about 5% dipentaerythritol, 90% tripentaerythritol and higher oligomers was prepared. For the reaction 668 parts isostearic acid containing about 20% $C_{14-18}$ straight-chain fatty acids was combined with 82 parts of the di-/tripentaerythritol product and the reaction mixture heated at 240° C. until a hydroxyl value less than 10 was achieved. After a vacuum was applied to remove excess isostearic acid, the resulting ester product which consisted predominantly of tripentaerythritol octaisostearate had the following physical characteristics:

| | |
|---|---|
| Acid Value | 4.7 |
| Hydroxyl Value | 2.4 |

-continued

| | |
|---|---|
| 210° F. Viscosity | 33.1 cSt. |
| 100° F. Viscosity | 344.7 cSt. |
| Pour Point | 20° F. |
| Flash Point | 520° F. |
| Fire Point | 635° F. |

When the product subjected to thermogravimetric analysis in accordance with the previously described procedure, only 10% weight loss of the product was observed at 750° F.

The polyol ether esters of this invention derived from isostearic acid have many advantages and reduce the cost of equipment maintenance where continuous operation under the severe service conditions encountered at high temperatures is involved. For example, in view of their excellent viscosity characteristics, these ester lubricants are capable of being readily pumped through small nozzels or openings or can be applied using a variety of other methods. They can also be applied by passage through an oil bath and by gravity feed or by brush or wheel. This permits the use of these lubricants with virtually all chain types. For example, the polyol ether esters are effectively used with roller chains, open-type detachable chains and closed-type pintle chains constructed from a variety of materials and operated under varying speed and load conditions.

Still other advantages are obtained as a result of the low volatility and superior oxidative and thermal stability of the present polyol ether ester lubricants. These products remain on the lubricated surface under severe service conditions for extended periods thus reducing the amount of lubricant required. Furthermore, there is no significant buildup of residue resulting from decomposition products. Such residues are undesirable since they trap abrasive materials and promote wear. Minimal smoking is also observed with these products thus providing a better working environment. As a result of the low pour points of the polyol ether ester lubricants, the ester lubricants can be stored in unheated areas and will generally not require preheating prior to use.

We claim:

1. A polyol ether ester having a hydroxyl value less than 10, flashpoint greater than 500° F. and pour point less than 20° F. comprising the reaction product of a molar excess of isostearic acid, obtained as a by-product from the manufacture of polymer fatty acids from naturally occuring unsaturated $C_{18}$ fatty acids, and a polyol ether of pentaerythritol having from 6 to 8 hydroxyl groups and containing at least 85 percent by weight dipentaerythritol, tripentaerythritol and higher oligomers and less than 15% by weight monopentaerythritol.

2. A polyol ether ester according to claim 1 wherein the isostearic acid contains 25 percent or less straight-chain fatty acids.

3. A polyol ether ester according to claim 2 wherein the ratio of dipentaerythritol to tripentaerythritol is in the range 9:1 to 1:9 and the monopentaerythritol content is less than 10 percent.

4. Dipentaerythritol hexaisostearate.

5. Tripentaerythritol octaisostearate.

* * * * *